US008398424B1

(12) United States Patent
Vasavda et al.

(10) Patent No.: US 8,398,424 B1
(45) Date of Patent: Mar. 19, 2013

(54) POWER CORD RETAINER

(75) Inventors: Samir Vasavda, Fremont, CA (US); Edward Kliewer, Sunnyvale, CA (US); George Curtis, San Jose, CA (US); Kenneth R. Martin, Morgan Hill, CA (US); William Oberlin, Sunnyvale, CA (US)

(73) Assignee: Cisco Technology, Inc., San Jose, CA (US)

( * ) Notice: Subject to any disclaimer, the term of this patent is extended or adjusted under 35 U.S.C. 154(b) by 0 days.

(21) Appl. No.: 13/224,679

(22) Filed: Sep. 2, 2011

(51) Int. Cl.
*H01R 13/62* (2006.01)

(52) U.S. Cl. ..... 439/371

(58) Field of Classification Search ..... 439/92, 439/98–100, 83, 367, 371, 373; 24/16 PB
See application file for complete search history.

(56) References Cited

U.S. PATENT DOCUMENTS

| | | | | | |
|---|---|---|---|---|---|
| 3,163,481 | A | * | 12/1964 | Salvador | 439/371 |
| 3,960,432 | A | * | 6/1976 | Wilbur | 439/451 |
| 4,052,655 | A | * | 10/1977 | Vizza | 320/109 |
| 4,440,465 | A | * | 4/1984 | Elliott et al. | 439/369 |
| 4,557,024 | A | * | 12/1985 | Roberts et al. | 24/20 TT |
| 4,663,807 | A | | 5/1987 | Bozzo | |
| 4,840,345 | A | | 6/1989 | Neil et al. | |
| 5,024,405 | A | * | 6/1991 | McGuire | 248/73 |
| 5,096,430 | A | * | 3/1992 | D'Amico | 439/148 |
| 5,397,243 | A | * | 3/1995 | MacMurdo, Sr. | 439/136 |
| 5,772,258 | A | | 6/1998 | Dyer et al. | |
| 6,939,161 | B1 | * | 9/2005 | Yi et al. | 439/373 |
| 7,207,826 | B1 | * | 4/2007 | Yang | 439/373 |
| 7,284,302 | B2 | * | 10/2007 | Lares | 24/16 PB |
| 7,513,791 | B1 | * | 4/2009 | Gary | 439/373 |
| 7,938,671 | B2 | * | 5/2011 | Hayden, Sr. | 439/371 |

OTHER PUBLICATIONS

Hellerman Tyton Catalog, Snapper Hose Clamps, 2010, (1 page).

* cited by examiner

*Primary Examiner* — Phuongchi Nguyen
(74) *Attorney, Agent, or Firm* — Edell, Shapiro & Finnan, LLC

(57) ABSTRACT

A device includes an elongated strap, a latch structure connected to the strap and configured to receive and secure a portion of the strap within the latch structure when an end of the strap is inserted through an opening of the latch, and a clamping structure secured to the strap. The clamping structure includes a flexible ring member with two free ends that are separable from each other to define a gap between the two free ends and are further configured to be drawn toward each other such that one free end overlaps the other free end, and a locking mechanism that is operable by a user to selectively compress the ring member so as to secure a portion of at least one power cord within the ring member.

11 Claims, 8 Drawing Sheets

POWER CORD RETAINER

TECHNICAL FIELD

The present disclosure relates to a retainer to maintain connection of one or several power cords with one or more electronic devices.

BACKGROUND

Power cords are used for a number of different electronic devices to connect the electronic devices to an electrical power source (e.g., a wall outlet, a power strip or some other suitable power source). Typically, a power cord is removably connected to the housing of an electronic device (e.g., at a rear surface of the device), where the power cord includes a male or female frictional engagement fitting connection at one end that mechanically and electrically couples or connects the power cord to the electronic device and another male connector (e.g., a three prong connector) that mechanically and electrically connects the power cord to the power supply outlet.

Such removable power cords are useful in that they can be easily separated from an electronic device for a number of reasons when the device is not being used (e.g., to provide easier transport of the electronic device, to facilitate interchangeable or universal use of the power cord with two or more electronic devices, etc.). However, this removable feature can also result in an undesirable or unintentional disengagement of the power cord from the electronic device during use (e.g., caused by an individual accidentally snagging the power cord with an arm or foot or by some other moving object). This can result in a temporary loss of electrical power for the electronic device.

DESCRIPTION OF EXAMPLE EMBODIMENTS

Overview

A device is provided that comprises an elongated strap, a latch structure connected to the strap and configured to receive and secure a portion of the strap within the latch structure when an end of the strap is inserted through an opening of the latch, and a clamping structure secured to the strap. The clamping structure comprises a flexible ring member including two free ends that are separable from each other to define a gap between the two free ends and are further configured to be drawn toward each other such that one free end overlaps the other free end, and a locking mechanism that is operable by a user to selectively compress the ring member so as to secure a portion of at least one power cord within the ring member.

In addition, a method is provided that involves extending an end of a strap of a cord retainer device through a loop structure disposed on a housing wall of an electronic device. After extending the first end of the strap through the loop structure, the first end is looped back and the first end is extended through an opening in a latch structure secured to the strap. A portion of the strap that extends through the latch structure is secured by the latch structure, a mating connector of a power cord is connected with a corresponding mating connector disposed on the housing of the electronic device, and a portion of the power cord is secured within a clamping structure of the cord retainer, where the clamping structure is secured to the strap, such that the mating connector of the power cord is maintained within and resistant to removal from the mating connector of the electronic device.

Example Embodiments

Figure 1:
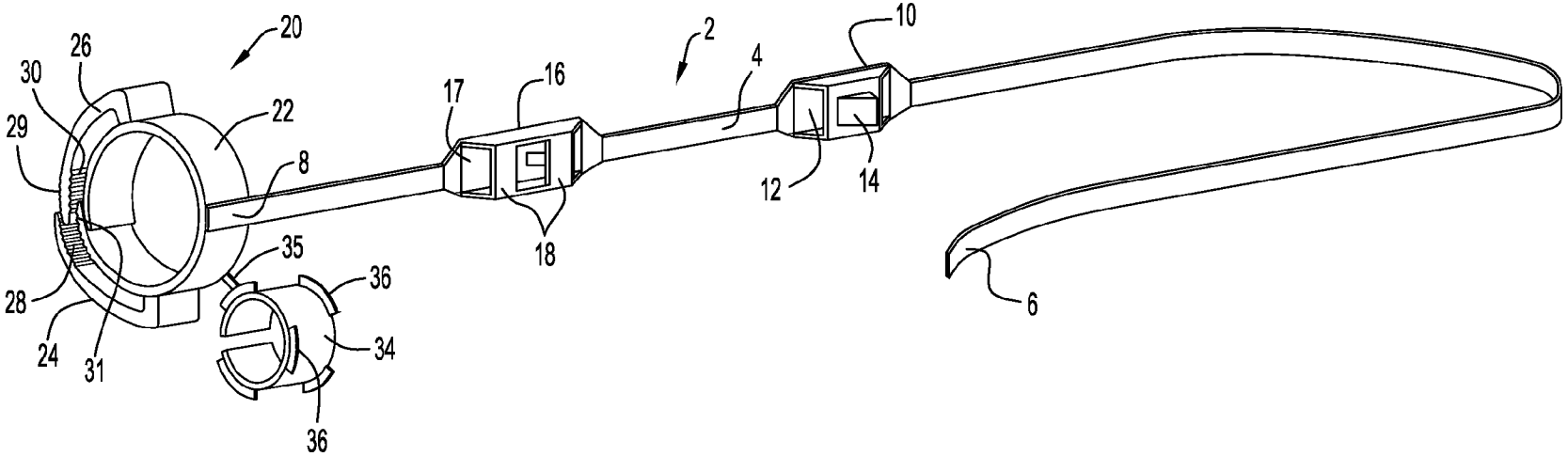
FIG. 1 is front view in plan of an example power cord retainer that maintains a connection between a power cord and an electronic device.

Referring to FIG. 1, a power cord retainer 2 includes a flexible and elongated strap 4 that is used to secure a power cord to an electronic device (e.g., in a manner as shown in FIGS. 2-7). A cord clamp 20 is secured at one end 8 of the strap 4. In addition, a latch 10 and a retaining clip 16 are secured at locations along the strap 4 between the cord clamp 20 and the free end 6 of the strap 4. Each of the strap 4, cord clamp 20, latch 10 and retaining clip 16 can be constructed of suitable materials (e.g., plastic) that renders each component suitable for operating in the manner described below.

The latch 10 of the strap 4 includes a base 12 and a latching member 14 that is separated from the base 12 so as to facilitate insertion of a portion of the strap 4, including its free end 6, through an opening defined between latching member 14 and base 12 during assembly of the retainer 2 with an electronic device. In addition, the latching member 14 is pivotally secured to the base 12 to facilitate a frictional securing or locking engagement with the strap 4 at the location at which a strap portion extends through the latch opening when the latching member 14 is pressed toward the base 12, thus preventing movement of the secured strap portion from this locking engagement until the latching member 14 is moved away from the base 12.

The retaining clip 16 includes a base 17 and one or more bridge members 18 that are separated from the base to define an opening between each bridge member 18 and the base 17. During use, the free end 6 of the strap 4 is inserted through these openings of the retaining clip 16 so as to maintain the free end 6 against the strap 4 after assembly and engagement with a power cord.

The cord clamp 20 includes an outer annular or ring member 22 having a configuration where the ring is open and has two closely spaced ends facing toward each other and separated by a slight gap. The ring member 22 has a sufficient flexibility to facilitate compression of the ring member 22, by moving one free end of the ring member 22 into an overlapping relationship with the other free end of the ring member 22, which reduces the initial diameter/size dimension of the ring member 22 in an uncompressed or relaxed state (where the two ring member facing ends do not overlap or only slightly overlap) to a smaller diameter dimension (where there is a portion of overlap between the two ring member facing ends that is greater than any overlap of the facing ends in the uncompressed or relaxed state). The ring member 22 is preferably constructed of a flexible material that allows compression of the ring member 22 by overlapping of its free ends and also flexure back to its original, relaxed state when no compression forces are applied to the ring member 22. In addition, the free ends of the ring member 22 can be flexed apart to separate the free ends a selected distance (e.g., to facilitate installation of the ring member 22 around a power cord.

First and second locking members 24, 26 are connected at outer surface portions of the ring member 22, where each locking member 24, 26 extends at a slight distance from the outer surface of the ring member 22 and is curved so as to extend around a portion of the circumference of the ring member 22. The locking members 24, 26 extend toward each other such that a free end of the first locking member 24 overlaps a free end of the second locking member 26 at a location generally corresponding with the overlap of the ring member facing ends.

In addition, the first locking member includes a plurality of teeth 28 disposed along a surface at its free end that faces the second locking member 26, while the second locking member 26 also includes a plurality of teeth 29 disposed along a surface at its free end that faces the first locking member 24. The teeth 28, 29 of both locking members 24, 26 are configured to engage with each other to provide a ratchet type locking engagement between the two locking members as the free end of the first locking member 24 is moved from an initial overlapped position in relation to the free end of the second locking member 26 to further overlapped positions in which a greater dimension of the first locking member 24 overlaps the second locking member 26. The movement of the first locking member 24 into different overlapped positions in relation to the second locking member 26 facilitates overlapping of the ring member free ends and thus a corresponding change in the diameter of the ring member 22, where the different overlapped positions of the locking member free ends are maintained due to the locking engagement of the corresponding teeth 28 for the first and second locking members 24, 26.

Optionally, the second locking member 26 also includes a plurality of teeth 30 disposed along a surface of its free end that faces the ring member 22, while a corresponding portion of the ring member 22 that underlies the first locking member 24 includes a plurality of teeth 31 disposed on a surface of the ring member 22 that faces outward toward each of the first and second locking members 24, 26. The plurality of teeth 31 extend to one of the free ends of the ring member 22 that overlaps the other free end when the ring member 22 is compressed, and the teeth 31 are configured to engage with the teeth 30 of the second locking member 26 when the ring member 22 is compressed to overlap the facing open ends of the ring member 22 so as to provide an additional ratchet type locking arrangement between the compressed ring member 22 and the second locking member 26.

While the locking members 24, 26 are shown in the example embodiments of the figures, it is noted that any suitable locking mechanism can be utilized to compress the ring member 22 to achieve clamping of one or more power cords extending through the cord clamp structure.

The cord clamp 20 further includes an inner ring member 34 that provides for selective reduction in the clamping space as defined by the inner diameter of the outer ring member 22. The inner ring member 34 can optionally be removably secured to the outer ring member 22, as shown in FIG. 1, by a breakable bridging member 35 (e.g., a plastic connection that can be fractured to free the connection between the two ring members).

The inner ring member 34 is similar in configuration to the outer ring member 22 in that the inner ring member 34 is open and has two closely spaced ends facing toward each other and separated by a slight gap, where the inner ring member 34 has a sufficient flexibility to facilitate compression of the inner ring member 34, by moving one free end of the inner ring member 34 into an overlapping relationship with the other free end of the inner ring member 34, so as to reduce the diameter/size dimension of the inner ring member 34. The inner ring member 34 is suitably dimensioned so as to fit concentrically within the outer ring member 22 when the outer ring member 22 is in its initial or uncompressed state. The inner ring member 34 is also preferably constructed of a flexible material that allows compression of the ring member 34 by overlapping of its free ends and also flexure back to its original, relaxed state (e.g., with a slight gap between the free ends) when no compression forces are applied to the ring member 34.

Figure 6:
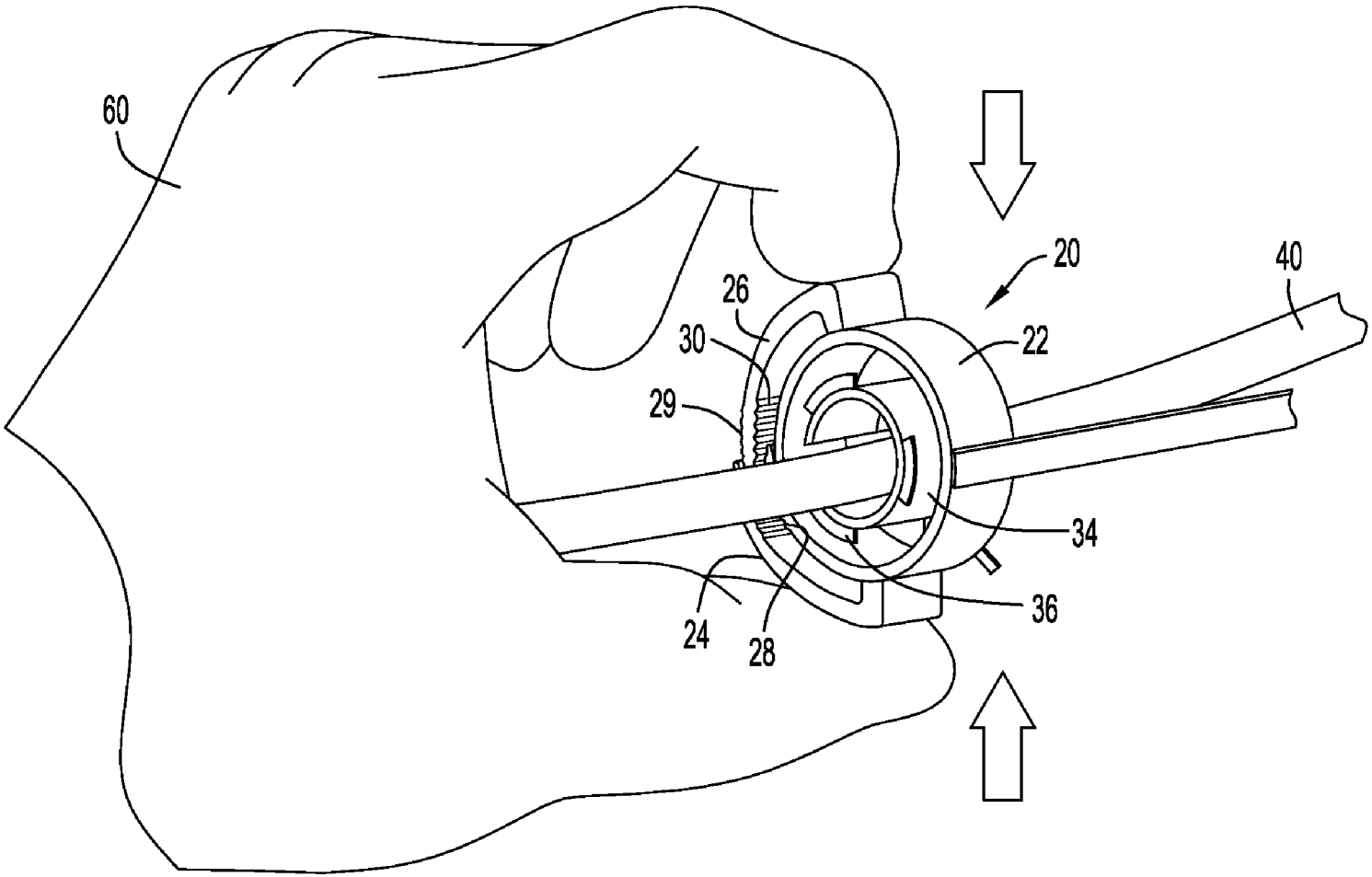
Figure 7:
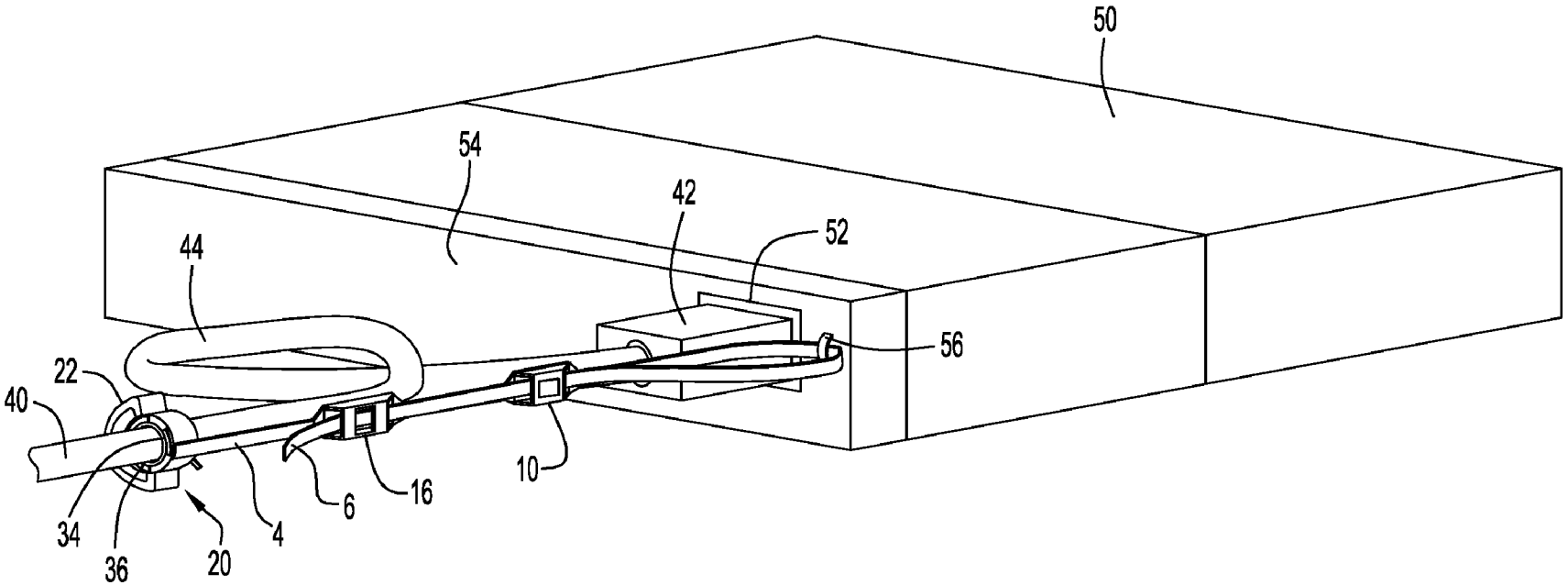

The inner ring member 34 also includes a plurality of flanges 36 located at circumferentially spaced locations along and extending outward from edge portions of the inner ring member 34. The flanges 36 are configured to flex slightly, as necessary, to permit the inner ring member 34 to be inserted within the outer ring member 22 such that the inner ring member 34 is concentrically located with the outer ring member 22. Alternatively, the inner ring member 34 may be sufficiently smaller than the outer ring member 22 to facilitate easy installation of the inner ring member 34 concentrically within the outer ring member 22 (as shown in FIG. 6) prior to compression of both ring members. After such insertion and/or sufficient compression of the outer ring member 22 (which reduces the outer ring member size so as to fit in a tight frictional fit relationship with respect to the inner ring member 34, as shown in FIG. 7), the flanges 36 engage with corresponding side edges of the outer ring member 22 so as to maintain the inner ring member 34 within the outer ring member 22.

Figure 2:
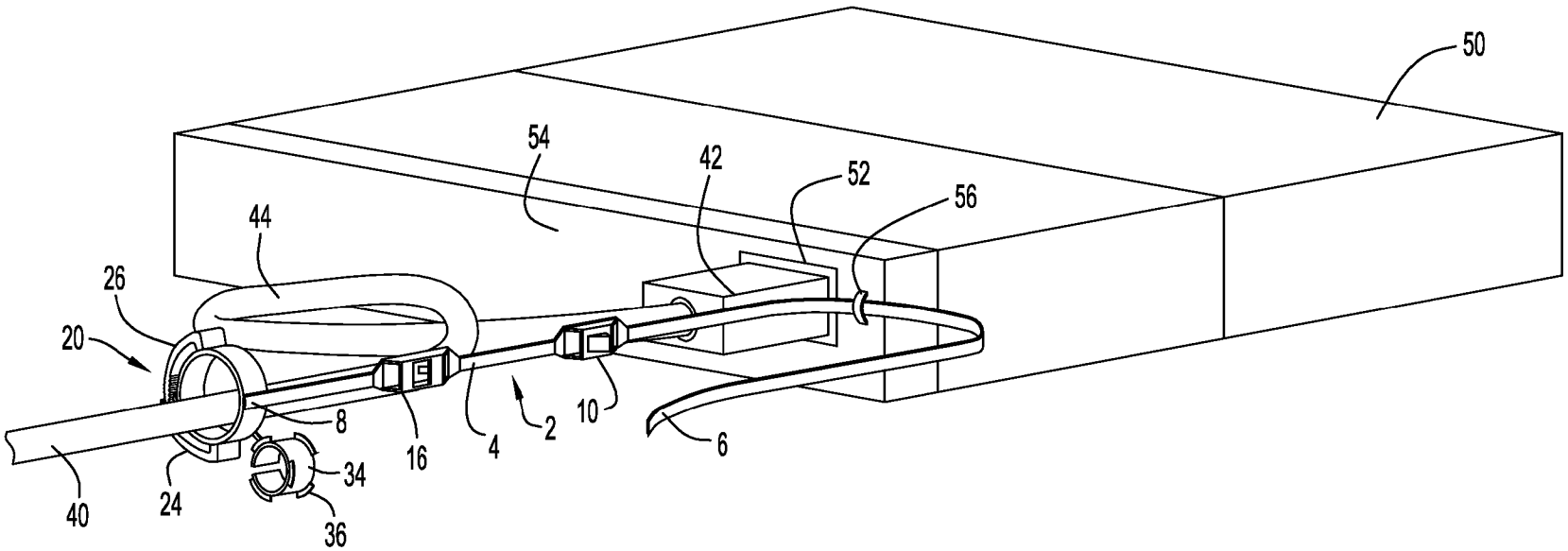
FIGS. 2 through 8 are views showing example assemblies of the power cord retainer of FIG. 1 with one or more power cords engaged with one or more electronic devices.

Operation of the power cord retainer is now described with reference to FIGS. 2-7. Referring to FIG. 2, a power cord 40 includes a mating connector 42 located at one end that connects within a corresponding mating connector 52 of an electronic device 50. The power cord retainer 2 can be used with any suitable one or more electronic devices including, without limitation, computer related hardware and other office equipment devices (e.g., routers, servers, network distribution switches, desktop or laptop computer systems, external hard drive devices, scanners, printers, photocopiers, fax machines, etc.), audio and/or video equipment (e.g., amplifiers, video monitors, various types of audio, video and/or internet telephones, etc.), medical and/or laboratory electronic devices, and various other types of electronic equipment for home or other uses.

The mating connectors of the power cord 40 and the electronic device 50 can be of any suitable types. In an example embodiment, the mating connector 52 of the electronic device 50 is a male connector disposed on a rear surface 54 of the housing of the device 50, where the male connector 50 includes three prongs slightly recessed from the rear surface 54. In this example, the mating connector 42 of the power cord 40 includes three female mating slots configured to receive the prongs of the electronic device mating connector 52 when the power cord mating connector 42 is inserted into the recess of the rear surface 54. Another mating connector (not shown) is also disposed at the opposing end of the power cord 40, where this mating connector connects with an electrical power source in any suitable manner (e.g., a three prong male mating connector for the power cord 40 that connects with a corresponding female three hole wall outlet, such as a standard 120 volt grounded outlet).

The power cord retainer 2 is initially aligned with the power cord 40 such that a portion of the power cord 40 extends through the ring member 22 of the cord clamp 20. For example, the two facing ends of the ring member 22 and also the first and second locking members 24, 26 can be separated from each other to form a gap that permits insertion of the portion of the power cord 40 through the gap so as to be disposed within the opening or clamping space as shown in FIG. 2. Alternatively, and depending upon its size in relation to the cord clamp 20, the power cord mating connector 42 can be inserted through the ring member 22 prior to connection with the corresponding mating connector 52 of the electronic device. As further shown in FIG. 2, a portion of the power cord 40 forms a loop 44 between the mating connector 42 and the cord clamp 20 of the power cord retainer 2. This loop 44 in the power cord 40 is not required but can be provided, for example, in scenarios in which it is desirable to remove an excess portion or slack in the power cord 40 prior to connecting to an electrical power source. In other words, the loop 44 can be selectively provided to reduce the length of the portion of the power cord 40 that extends beyond the cord clamp 20 to the power source outlet so as to minimize the possibility for someone's limb (e.g., a leg or foot) or some other object to inadvertently snag this portion when the electronic device 50 is electrically connected to the power source.

Figure 3:
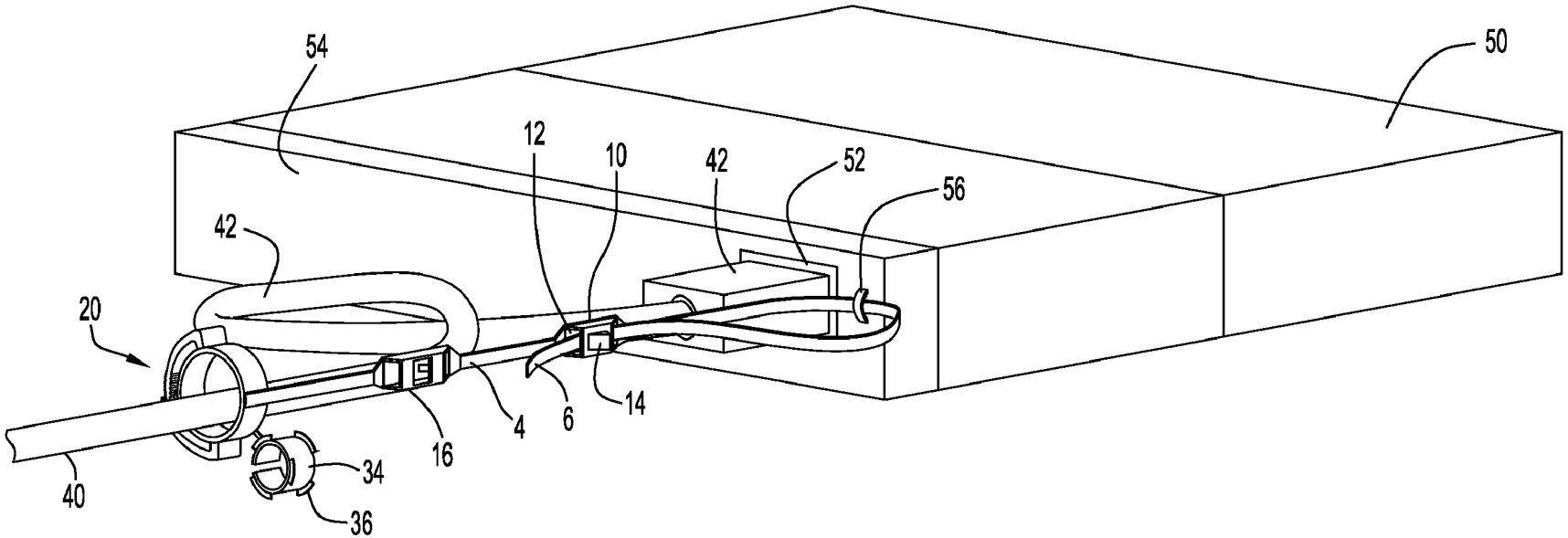
Figure 4:
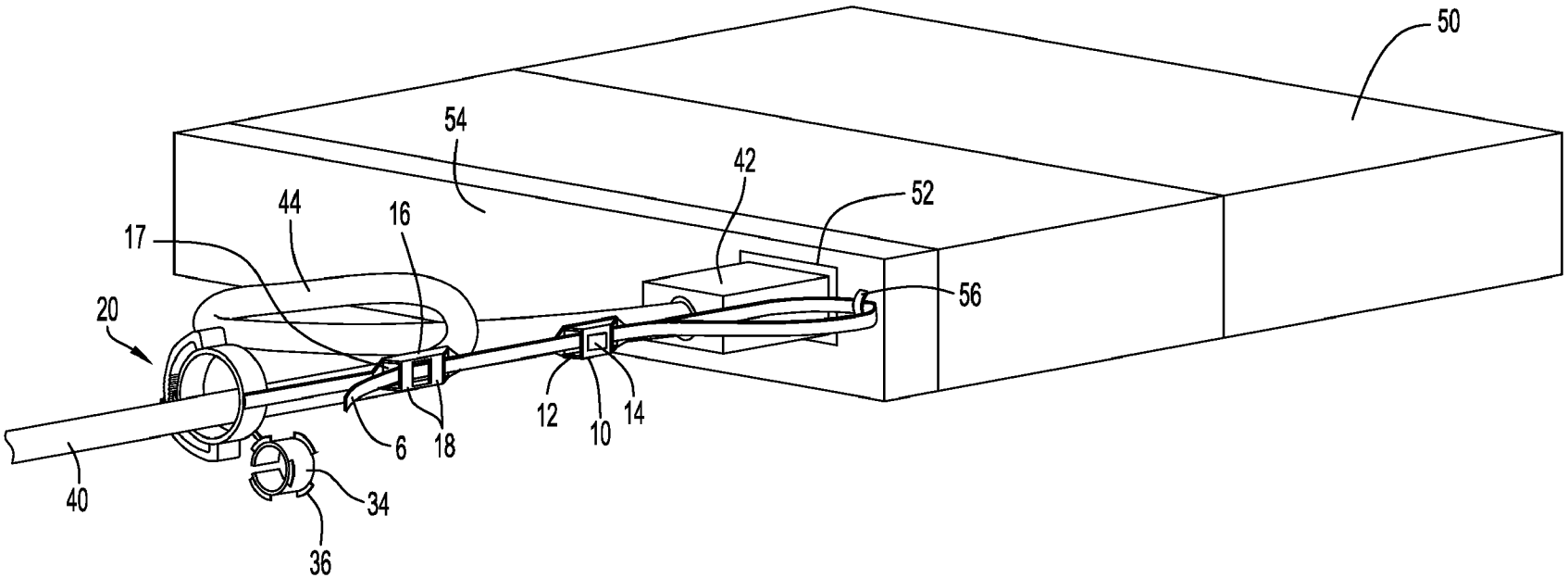

A rigid loop structure 56 is disposed on the rear surface 54 at a location proximate the mating connector 52 so as to define a gap between the loop structure 56 and the rear surface 54. The loop structure 56 can be constructed, e.g., from metal or plastic or any other suitable material. The loop structure 56 can be an integral part of the rear surface 54 of the electronic device (e.g., formed as part of the rear surface 54). Alternatively, the loop structure 56 can be affixed to the rear surface 54 in any suitable manner (e.g., via an adhesive, via welding or any other sort of securing structure). The free end 6 of the power cord retainer strap 4 is inserted through the gap of the loop structure 56, as shown in FIG. 2, such that the remaining portion of the strap between the loop structure 56 and the cord clamp 20 is close to or even engaging portions of the power cord 40. As shown in FIG. 3, the free end 6 of the strap 4 is then turned around and back upon itself and is inserted through the opening defined between the base 12 and the latching member 14 of the latch 10, thus forming a loop in a portion of the strap 4 that extends from a location at which the latch 10 is secured to the strap to a portion of the strap that is secured by the latch 10. Referring to FIG. 4, the free end 6 of the strap 4 is then directed through the opening defined between the base 17 and the bridge members 18 of the retaining clip 16 such that a selected portion including the free end 6 of the strap 4 extends beyond the retaining clip 16.

The latching member 14 of the latch 10 can be engaged with the strap 4 at any time (by pressing the latching member 14 toward the base 12) after the free end 6 of the strap 4 has been extended through the latch 10 (e.g., in the configuration as shown in FIG. 3 or in FIG. 4), and engagement of the latching member 14 with the strap 4 results in a frictional locking of the portion of the strap 4 that is located within the opening of the latch 10 so as to substantially maintain a constant length of the loop defined in the strap 4 (i.e., the length of the portion of the strap from where the latch 10 is secured to the strap 4 to a location at which the strap 4 is frictionally held by the latch 10). This frictional locking of the strap can be released by disengaging the latching member 14 from the strap 10. The locking of the strap 4 in this manner provides a first anchor point (at the loop structure 56 of the electronic device 50) for retaining the mating connector 42 of the power cord 40 with the mating connector 52 of the electronic device 50. The engagement of the strap 4 with the retaining clip 16 maintains the free end 6 of the strap 4 in close proximity with the power cord 40.

Figure 5:
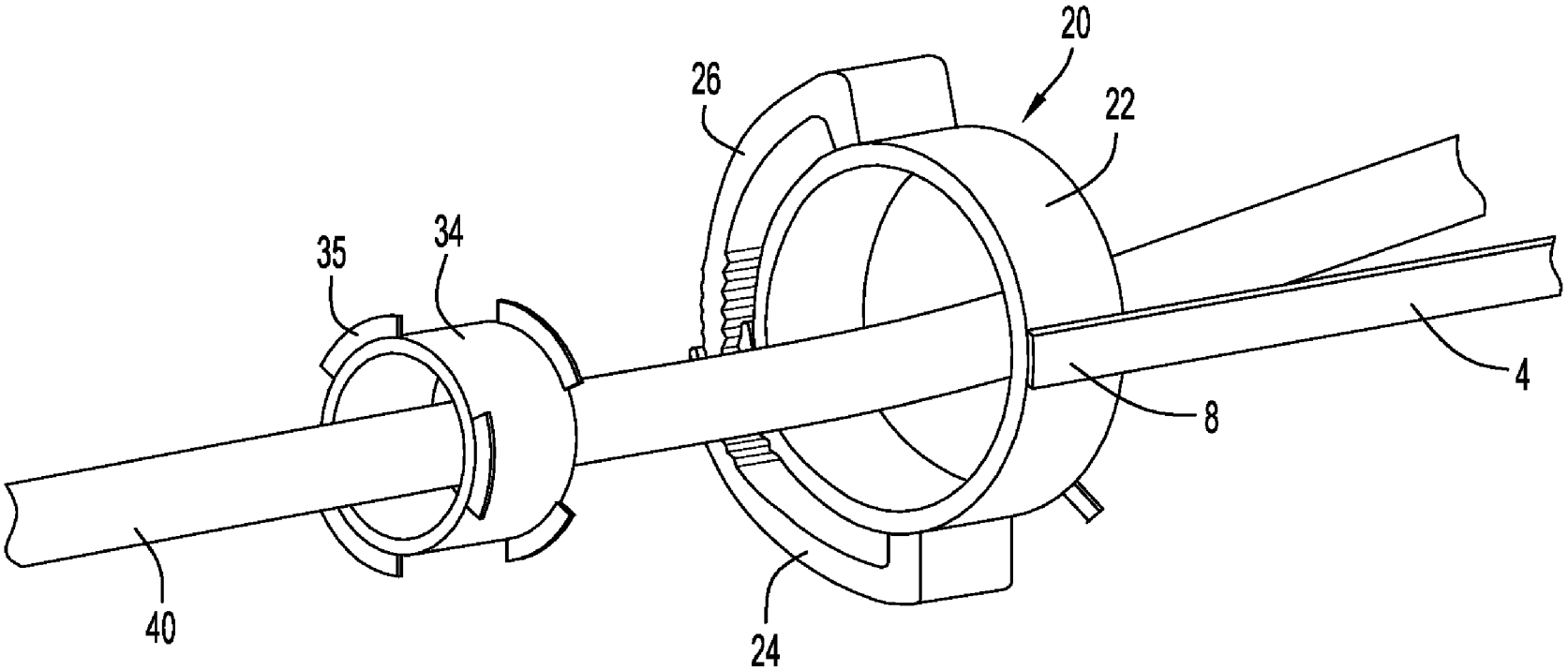

A second anchor point for the power cord is provided by clamping a portion of the power cord with the cord clamp 20 of the retainer 2. Referring to FIGS. 5-7, a decision is made by the installer regarding whether the inner ring member 34 is needed to clamp the power cord 40 within the cord clamp 20. For example, depending upon the cross dimension or diameter of the power cord (or whether multiple power cords are to be secured within the cord clamp 20), the inner ring member 34 may or may not be needed to achieve the desired clamping effect. In the embodiment of FIGS. 5-7, the inner ring member 34 is used as part of the cord clamp 20 to clamp the power cord 40. The inner ring member 34 is disconnected from the outer ring member 22 (by breaking the bridging member 35) and is connected around the power cord (as shown in FIG. 5), e.g., by spreading the facing free ends of the inner ring member 34 to widen the gap therebetween so as to fit the inner ring member 34 around the power cord 40. The inner ring member 34 is then fit concentrically within the outer ring member 22, as shown in FIG. 6.

The installer 60 presses the first and second locking members 24, 26 together (i.e., in the directions shown by the arrows in FIG. 6) such that the free ends of the locking members move toward each other, with the first locking member 24 overlapping the second locking member 26, and the teeth 28 of the first locking member 24 engage with the teeth 29 of the second locking member 26 to lock the locking members 24, 26 in this connected configuration. The overlapping of the locking members 24, 26 also causes an overlapping of the free ends of the outer ring member 22 and also an overlapping of the free ends of the inner ring member 34, resulting in a reduction of the size/diameters of the ring members 22, 34. In addition, during this pressing action, the teeth 30 of the second locking member 26 engage with the teeth 31 of the inner ring member 34 to provide a further locking engagement for the cord clamp 20.

The further pressing by the installer 60 increases the overlap of the second locking member 26 by the first locking member 24, and corresponding overlapping of the free ends of each of the inner ring member 34 and the outer ring member 22, to eventually achieve a suitable reduction in size/diameter of each ring member 22, 34 and a resultant frictional engagement between the inner ring member 34 and a portion of the power cord 40 that extends through the cord clamp 20. The ratcheting/locking action of the engaging teeth 28, 29 between the first and second locking members 24, 26 and also the engaging teeth 30, 31 between the second locking member 26 and the outer ring member 22 facilitates a locking of each ring member 22, 34 into a gradual progression of compressed configurations in which the size/diameter of each ring member 22, 34 becomes progressively reduced. This allows for the cord clamp 20 to achieve locked configurations at a number of different compressed diameter/size dimensions in order to effectively engage with one or more power cords having different cross-sectional or diameter dimensions.

After achieving a tight frictional engagement between the inner and outer ring members 22, 34 and also a corresponding tight frictional engagement between the inner ring member 34 and the power cord 40 (as shown in FIG. 7) due to the pressing action of the first and second locking members 24, 26 toward each other, the cord clamp 20 is effectively locked with a portion of the power cord 40 (which prevents or significantly limits movement of the cord clamp 20 with respect to the portion of the power cord 40 to which it is secured) and thus provides a second anchor point for the power cord 40. The locking of the power cord retainer 2 with the power cord 40 in this configuration significantly limits movement of the power cord 40 from the two anchor points defined at the loop structure 56 of the electronic device and the cord clamp 20 of the power cord retainer 2. The only ease or freedom of movement of the power cord 40 that may be allowed would be due to any slack or freedom of movement of the strap 4. However, such freedom of movement can be limited or controlled by pulling the free end 6 of the strap 4 through the latch 10 such that it is taut (or has only a small amount of slack) and then locking the strap 4 by the latch in this configuration. This locking of the power cord 40 at the two anchor points thus substantially limits inadvertent removal of the mating connector 42 of the power cord 40 from its engagement/electrical connection with the corresponding mating connector 52 of the electronic device 50.

The locking engagement of the power cord retainer 2 with the power cord 40 can be released by separating the first and second locking members 24, 26 (e.g., by first lifting the free end of the first locking member 24 slightly away from the second locking member 26 to disengage the teeth 28, 29) and also separating the second locking member 26 from the outer ring member 22 (e.g., by first lifting the free end of the second locking member 26 slightly away from the outer ring member 22 to disengage teeth 30, 31). This allows the ring members 22, 34 to flex back to larger size/diameter dimensions (e.g., flexing to their original, relaxed and non-compressed states), since the compressing forces applied to these ring members are released by separation of the locking members 24, 26. The portion of the strap 4 including its free end 6 can also be released by the latch 10, and the free end 6 can be pulled through the loop structure 56 to free the strap 4 from the first anchor point so as to allow separation of the power cord retainer 2 from engagement of the power cord 40 and the electronic device 50.

Figure 8:
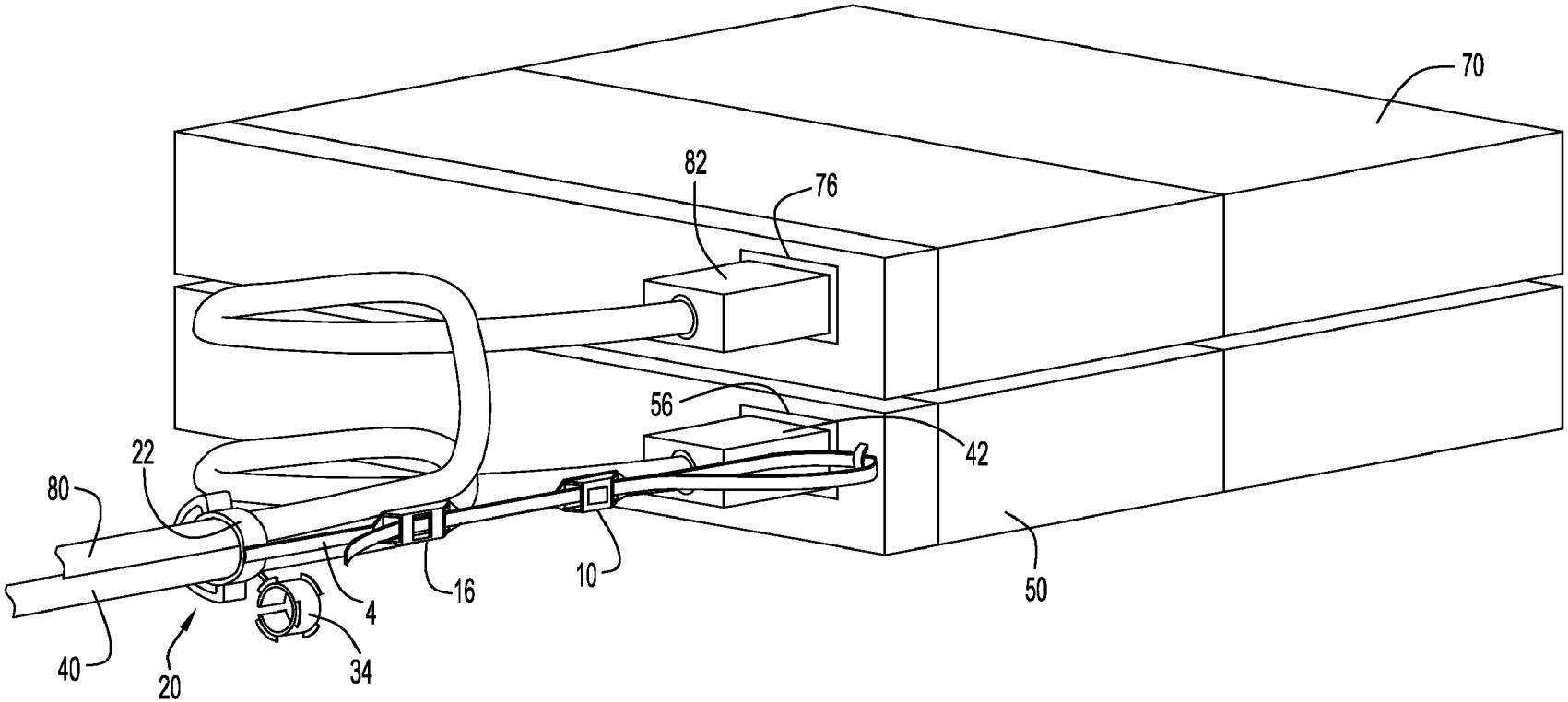

As previously noted, the power cord retainer 2 can also secure a plurality of power cords at one time. Referring to the embodiment of FIG. 8, two electronic devices 50, 70 are provided in a stacked arrangement, where each device includes a power cord 40, 80 that is secured by the cord clamp 20 of the power cord retainer 2 in a similar manner as described above for the embodiment shown in FIGS. 2-7. In this embodiment, the inner ring member 34 is not needed and is thus not used, since the cross-sectional dimension (i.e., the combined diameters) of the two power cords 40, 80 is large enough to enable effective clamping utilizing the outer ring member 22 by itself. The mating connector 42, 82 for each power cord 40, 80 is secured in a corresponding mating connector 56, 76 of the electronic device 50, 70 to which the power cord 40, 80 connects, and release or disengagement of the mechanical and electrical mating connection is prevented or substantially limited by operation of the power cord retainer 2.

Thus, the power cord retainer provides a releasable locking arrangement to secure a portion of a power cord, including its mating connector, with respect to an electronic device so as to prevent or substantially limit inadvertent removal of the mating connector from its mechanical and electrical mating connection with a corresponding mating connector of the electronic device. The releasable locking engagement between corresponding teeth of the locking members (and also between the corresponding teeth of one of the locking members and the outer ring member), as well as the selective use of the inner ring member, provide a clamping arrangement for different sized power cords and also for two or more power cords to be effectively clamped so as to prevent or substantially limit inadvertent dislodging of one or more power cords from connection with their respective electronic devices (e.g., due to someone accidentally tripping over or snagging a power cord while moving past an electronic device).

The above description is intended by way of example only.

What is claimed is:

1. A device comprising:

an elongated strap;

a latch structure connected to the strap and configured to receive and secure a portion of the strap within the latch structure when an end of the strap is inserted through an opening of the latch; and a clamping structure configured to be secured to the strap, the clamping structure comprising:

a flexible ring member including two free ends that are separable from each other to define a gap between the two free ends and are further configured to be drawn toward each other such that one free end overlaps the other free end;

a locking mechanism that is configured to be operable by a user to selectively compress the ring member so as to secure a portion of at least one power cord within the ring member, wherein the locking mechanism comprises a first locking member extending from the ring member and including a first free end, and a second locking member extending from the ring member and including a second free end that faces toward the first locking member, and wherein the first free end overlaps the second free end during compression of the ring member by the locking mechanism;

a plurality of teeth disposed on a portion of a free end of the ring member; and a plurality of teeth disposed on a surface of the second free end of the second locking member that faces the ring member, wherein the plurality of teeth disposed on the surface of the second free end of the second locking member that faces the ring member are configured to engage with the teeth on the free end of the ring member to lock the second free end of the second locking member with the free end of the ring member during compression of the ring member by the locking mechanism;

wherein the clamping structure further comprises an inner ring member including a flexible material with two free ends that are separable from each other to define a gap between the two free ends and are further configured to be drawn toward each other such that one free end overlaps the other free end of the inner ring member; and wherein the inner ring member is configured to fit concentrically within the ring member so as to become compressed along with the ring member during operation of the locking mechanism.

2. The device of claim 1, wherein a first end of the strap is configured to be inserted through the opening of the latch and the clamping structure is disposed proximate a second end of the strap that opposes the first end.

3. The device of claim 1, wherein the locking mechanism is operable to compress and maintain the ring member at a plurality of configurations having different size dimensions of the ring member.

4. The device of claim 1, further comprising a plurality of teeth disposed on facing surfaces of the first and second free ends, wherein the teeth on the first free end are configured to engage with the teeth on the second free end to maintain a selected dimension of a portion of the first free end that overlaps the second free end.

5. The device of claim 1, wherein the inner ring member includes at least one flange that extends transversely from the inner ring member and configured to engage with a portion of the ring member when the inner ring member is concentrically disposed within the ring member and both the inner ring member and the ring member are compressed such that the ring member engages with the inner ring member.

6. The device of claim 1, wherein the inner ring member is releasably secured to the ring member so as to extend transversely from the ring member, and the inner ring member is configured to be selectively removable from the ring member to facilitate placement of the inner ring member concentrically within the ring member.

7. The device of claim 1, further comprising:

an electronic device including an electrical mating connector disposed on a housing wall of the electronic device; and a power cord including an electrical mating connector that is configured to be releasably securable with the mating connector of the electronic device;

wherein a portion of the power cord is configured to be securable by the clamping structure when the portion of the power cord is placed within the ring member and the ring member is compressed by operation of the locking mechanism.

8. The device of claim 7, wherein the housing of the electronic device includes a loop structure configured to receive a portion of the strap, where the strap is suitably dimensioned and configured to facilitate looping the end of the strap through the loop structure of the electronic device and then through the latch structure secured to the strap.

9. A method comprising:

extending an end of a strap of a cord retainer device through a loop structure disposed on a housing wall of an electronic device;

after extending the first end of the strap through the loop structure, looping the first end back and extending the first end through an opening in a latch structure secured to the strap;

securing a portion of the strap that extends through the latch structure by the latch structure;

connecting a mating connector of a power cord with a corresponding mating connector disposed on the housing of the electronic device; and securing a portion of the power cord within a clamping structure of the cord retainer, the clamping structure being secured to the strap, such that the mating connector of the power cord is maintained within and resistant to removal from the mating connector of the electronic device;

wherein the clamping structure comprises a flexible ring member including two free ends that are separable from each other to define a gap between the two free ends and are further configured to be drawn toward each other such that one free end overlaps the other free end, and the securing of a portion of the power cord within the clamping structure further comprises:

compressing the ring member by overlapping one free end over the other free end of the ring member so as to secure the portion of the power cord within the ring member;

wherein the clamping structure further comprises a locking mechanism secured to the ring member, and the compressing of the ring member further comprises:

operating the locking mechanism to compress and maintain the ring member at a plurality of configurations having different size dimensions of the ring member;

wherein the locking mechanism comprises a first locking member extending from the ring member and including a first free end, and a second locking member extending from the ring member and including a second free end that faces toward the first locking member, and operating the locking mechanism further comprises:

moving the first free end to an overlapping position over the second free end to compress and maintain the ring member in a selected compressed configuration;

wherein the locking mechanism further comprises a plurality of teeth disposed on a portion of a free end of the ring member, and a plurality of teeth disposed on a surface of the second free end of the second locking member that faces the ring member, and operating the locking mechanism further comprises:

engaging the teeth disposed on the surface of the second free end of the second locking member that faces the ring member with the teeth on the free end of the ring member to lock the second free end of the second locking member with the free end of the ring member during compression of the ring member by the locking mechanism; and wherein the clamping structure further comprises an inner ring member including a flexible material with two free ends that are separable from each other to define a gap between the two free ends and are further configured to be drawn toward each other such that one free end overlaps the other free end of the inner ring member, and the securing of a portion of the power cord within the clamping structure of the cord retainer further comprises:

placing the inner ring member concentrically within the ring member prior to compressing the ring member, wherein compressing the ring member also compresses the inner ring member such that the inner ring member engages the portion of the power cord retained by the clamping structure.

10. The method of claim 9, wherein the inner ring member includes at least one flange that extends transversely from the inner ring member to engage with a portion of the ring member when the inner ring member is concentrically disposed within the ring member and both the inner ring member and the ring member are compressed.

11. The method of claim 9, wherein the inner ring member is releasably secured to the ring member so as to extend transversely from the ring member, and further comprising:

removing the inner ring member from the ring member to facilitate placement of the inner ring member concentrically within the ring member.

* * * * *